US005524526A

United States Patent [19]

Humbad

[11] Patent Number: 5,524,526

[45] Date of Patent: Jun. 11, 1996

[54] VACUUM MOTOR FOR AN AUTOMOTIVE VEHICLE

[75] Inventor: Niranjan G. Humbad, Novi, Mich.

[73] Assignee: Ford Motor Company, Dearborn, Mich.

[21] Appl. No.: 330,472

[22] Filed: Oct. 28, 1994

[51] Int. Cl.[6] ..... F01B 19/04; F16J 3/02

[52] U.S. Cl. ..... 92/98 D; 92/130 A

[58] Field of Search ..... 92/94, 98 R, 130 R, 92/130 A, 99, 100, 98 D

[56] References Cited

U.S. PATENT DOCUMENTS

| | | | |
|---|---|---|---|
| 3,082,792 | 3/1963 | Jenkins | 92/94 |
| 3,433,132 | 3/1969 | James | 92/98 R X |
| 3,575,088 | 4/1971 | Bauer | 92/98 R X |
| 3,657,966 | 4/1972 | Campbell | 92/99 X |
| 4,111,099 | 9/1978 | Fisher et al. | 92/94 X |
| 4,256,019 | 3/1981 | Braddick | 92/98 R X |
| 4,258,614 | 3/1981 | Aono . | |
| 4,403,538 | 9/1983 | Rise | 92/94 |
| 4,549,470 | 10/1985 | Yogo | 92/94 |
| 4,612,847 | 9/1986 | Bouvot et al. | 92/94 X |
| 4,838,771 | 6/1989 | Kikuchi . | |
| 5,161,453 | 11/1992 | Yared et al. | 92/98 R X |

FOREIGN PATENT DOCUMENTS

| | | | |
|---|---|---|---|
| 566246 | 7/1960 | Belgium | 92/130 R |
| 61-171873 | 8/1986 | Japan | 92/98 R |

*Primary Examiner*—John E. Ryznic

*Attorney, Agent, or Firm*—Raymond L. Coppiellie; Roger L. May

[57] ABSTRACT

A vacuum motor 10 for an automotive vehicle comprises a generally cylindrical housing 12 having an end wall 14 with the depression 16 therein and a diaphragm 22 axially reciprocating within the housing. The diaphragm includes an annular ridge 38 having a predetermined diameter which provides an interference fit for a spring 40 contained within the housing. The interference fit of the spring within the housing reduces the vibration of the spring and the objectionable noise produced by the vacuum motor.

4 Claims, 1 Drawing Sheet

VACUUM MOTOR FOR AN AUTOMOTIVE VEHICLE

BACKGROUND OF THE INVENTION

1. Field of the Invention

The present invention relates generally to vacuum motors for automotive vehicles. More particularly, the present invention relates to a vacuum motor which reduces the vibration of a spring contained therein.

2. Disclosure Information

Vacuum motors have long been used in the automotive industry to operate various components in an automobile. Typically, a vacuum motor is connected through valving to operate the automobile defroster and/or heating systems as desired as well as other systems or components within the vehicle. However, these vacuum motors often experience an undesirable noise, such as a buzzing, associated with their use. This "buzzing" has been attributed to the vibration of a spring contained within the housing of the vacuum motor which biases a diaphragm in a known manner.

Various vacuum motor designs have been proposed, but none heretofore has addressed the problem of the spring vibration. It would therefore be advantageous to provide a vacuum motor which reduces or prevents the vibration of the spring within the housing of the vacuum motor.

SUMMARY OF THE INVENTION

The present invention solves the problems associated with prior art vacuum motors by providing a vacuum motor for an automotive vehicle, comprising a generally cylindrical housing having an end wall with a frusto-conical-shaped depression having a predetermined diameter. The depression protrudes inwardly into the housing at a predetermined cone angle by a predetermined distance. The housing further includes a vacuum port extending through the depression. The vacuum motor also includes an axially reciprocating diaphragm cooperating with the housing to form a chamber therebetween, the diaphragm including a cup-shaped member and a flexible synthetic polymeric sealing member surrounding the cup-shaped member. The cup-shaped member has a base portion and a wall projecting generally perpendicularly from the base portion. The base portion includes a generally annular ridge formed therein having a predetermined diameter and projecting from the plane of the base portion by a predetermined distance at a predetermined cone angle. The vacuum motor further comprises a spring for biasing the diaphragm away from the end wall, the spring being disposed in the chamber between the end wall and the diaphragm. The spring has a predetermined diameter less than the diameter of the depression and the annular ridge such that one end of the spring is press-fit over the depression and the other end of the spring is press-fit over the ridge so as to form an interference fit between the spring ends and the depression and the annular ridge when the spring is compressed in the housing.

It is an advantage of the present that the spring is prevented from vibrating in the housing by the interference fit of the spring therein.

DETAILED DESCRIPTION OF THE PREFERRED EMBODIMENTS

Figure 1:
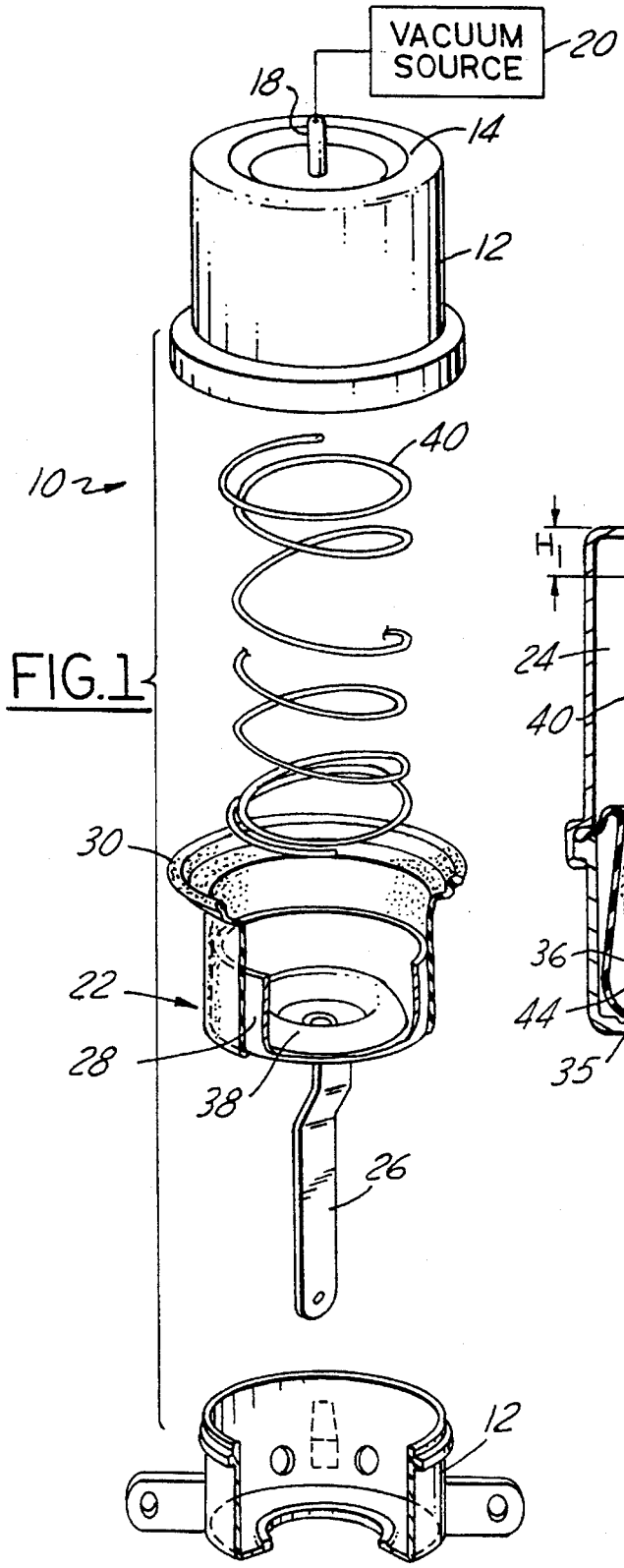
FIG. 1 is an exploded view of the preferred embodiment of the present invention.
Figure 2:
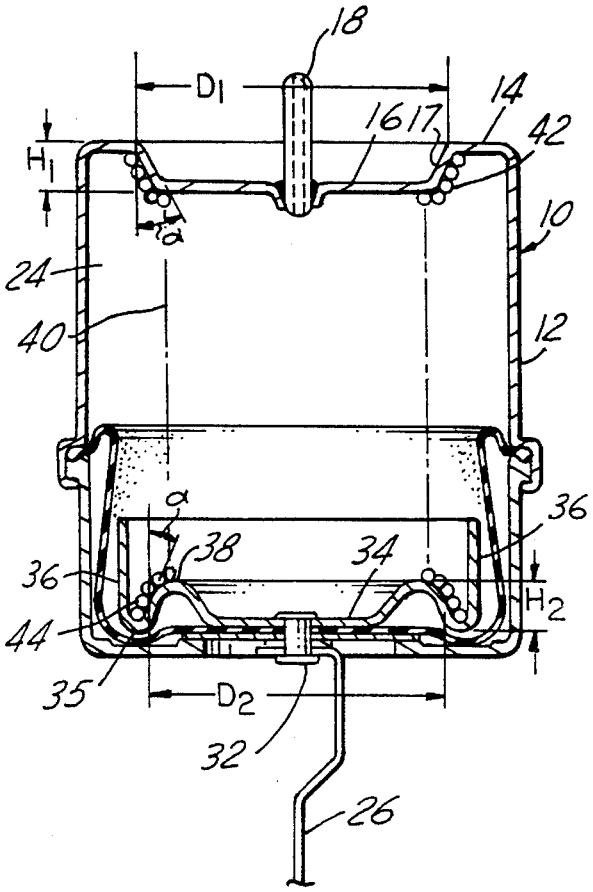
FIG. 2 is a cross-sectional view of the preferred embodiment of the present invention.

Referring now to the drawings, FIGS. 1 and 2 show a vacuum motor 10 embodying the principles of the present invention. The vacuum motor 10 includes a generally cylindrical, two-piece housing 12 having an end wall 14 at one end thereof. The end wall 14 includes a frusto-conical shaped depression 16 and a vacuum port 18 extending through the depression 16. The vacuum port 18 is connected by tubing to a vacuum source 20 in a known manner. The depression 16 includes a pair of sidewalls 17 disposed at an angle $\alpha$ to the endwall 14. The angle $\alpha$ is referred to herein as the cone angle and is defined as the angle of the sidewalls 17 to a line perpendicular to the plane of the endwall 14. This angle corresponds to the angle formed between the endmost coils of the spring used in the vacuum motor and the next adjacent coil in the spring. In the preferred embodiment, the cone angle is between 15–25 degrees which facilitates the spring being press-fit over the depression 16 as will be described below. The depression 16 also has a predetermined diameter ($D_1$) and a predetermined height ($H_1$). The height must be such that more than one coil of the spring is placed over the depression. The housing 12 may be manufactured from a variety of known materials such as aluminum or plastic.

The vacuum motor 10 further includes a diaphragm 22 disposed at an opposite end of the housing from the depression 16 and which cooperates with the housing to form a chamber 24 therebetween. As is well known, the diaphragm 22 axially reciprocates within the housing 12 and is connected to an arm 26. The arm 26 is connected to a mechanism to be operated by the vacuum motor, such as a mode selection door in a heating, ventilation and air conditioning system of an automotive vehicle.

The diaphragm 22 includes a generally cylindrical cup-shaped member 28 and a flexible synthetic polymeric sealing member 30 surrounding the cup-shaped member 28. The sealing member 30 is secured at the interface of the two pieces of the housing 12 and prevents the leaking of air from the vacuum motor 10 as is known in the art. A rivet 32 secures the arm 26 to the diaphragm 22 as well as the cup-shaped member 28 and the sealing member 30.

As further shown in FIG. 2, the cup-shaped member 28 includes a base portion 34 having a spring seat 35 formed between a cylindrical wall 36 projecting circumferentially therearound and an annular ridge 38 formed therein. The ridge 38 has a predetermined diameter ($D_2$) and a predetermined height ($H_2$). The ridge is also disposed at a predetermined cone angle $\alpha$ to the base thereof. The cone angle at the ridge 38 is the same as for the depression 16 because the cone angle is determined based on the spring geometry.

The preferred embodiment of the vacuum motor 10 further includes a coil spring 40 for biasing the diaphragm 22 away from the end wall 14 of the housing 12. The spring 40 has a first end 42 and a second end 44. The inner diameter of the spring 40 is less than the diameters of the depression 16 ($D_1$) and the annular ridge 38 ($D_2$) located in the base portion 34 of the cup-shaped member 28 of the diaphragm 22. In this manner, the first end of the spring 42 is press fit over the depression 16 of end wall 14 such that more than one coil of the spring 42 is disposed around the depression. Likewise, when the second end of the spring 44 is placed in spring seat 35, more than one coil at the second end of the spring 44 is circumferentially disposed around the annular ridge 38 of the diaphragm 22 such that the coils are press fit therearound. In the preferred embodiment, approximately one and one-half coils of the spring surround the depression 16 and ridge 38. In this manner, an interference fit is formed between the spring 40 and the depression 16 and ridge 38 of the vacuum motor when the vacuum motor is assembled and the spring is compressed therein.

Experimentation indicates that for one example of a helical spring 40 used in a typical vacuum motor, the spring has an inherent resonance of approximately 80 to 90 Hz. It was found that objectionable noise occurred at the resonance frequency when it coincided with the engine firing frequency. By providing an interference fit of the spring at both ends of the vacuum motor, the interference force produced thereat is sufficiently larger than the vibrational force of the motor at the resonance frequency which thereby reduces the noise produced by the vacuum motor. It has been determined that the noise level of the vacuum motor can be reduced by as much as 10–12 dBA by providing the interference fit as described in the preferred embodiment.

These and other modifications and alterations of the present embodiment will, no doubt, occur to those skilled in the art. For example, various other means of providing an interference fit of the spring into the diaphragm are within the scope of the present invention. It is the following claims, including all equivalents, which define the scope of the present invention.

What is claimed is:

1. A vacuum motor for an automotive vehicle, comprising:

a generally cylindrical housing having an end wall with a frusto-conical-shaped depression therein, said depression protruding inwardly into said housing a predetermined distance at a predetermined cone angle and having a predetermined diameter, said housing further including a vacuum port extending through said depression;

an axially reciprocating diaphragm cooperating with said housing to form a chamber therebetween, said diaphragm including a cup-shaped member and a flexible synthetic polymeric sealing member surrounding said cup-shaped member, said cup-shaped member having a base portion and a wall projecting generally perpendicularly from said base portion, said base portion including a generally annular ridge formed therein having a predetermined diameter and projecting from the plane of said base portion by a predetermined distance at said predetermined cone angle; and a spring for biasing said diaphragm away from said end wall, said spring being disposed in said chamber between said end wall and said diaphragm, said spring having a predetermined inner diameter less than the diameter of said depression and said annular ridge such that one end of said spring is press-fit over said depression and the other end of said spring is press-fit over said ridge so as to form an interference fit between said spring ends and said depression and said annular ridge, whereby said spring is prevented from vibrating in said housing by said interference fit therein.

2. A vacuum motor according to claim 1, wherein more than one coil of said spring circumferentially surrounds said depression.

3. A vacuum motor according to claim 2, wherein more than one coil of said spring circumferentially surrounds said annular ridge.

4. A vacuum motor according to claim 4, wherein said cone angle is between 15–25 degrees.

* * * * *